United States Patent [19]

Heaton

[11] 4,212,228

[45] Jul. 15, 1980

[54] POWER PLANT

[75] Inventor: Floyd L. Heaton, Mountain City, Tenn.

[73] Assignee: Fluid Engineering Co., Johnson City, Tenn.

[21] Appl. No.: 958,793

[22] Filed: Nov. 8, 1978

[51] Int. Cl.[3] ..... F01B 7/00

[52] U.S. Cl. ..... 91/170R; 91/321; 91/417 R; 60/369

[58] Field of Search ..... 60/369, 374, 408, 486, 60/567, 571; 91/170, 191, 218, 235, 321, 417, 4, 5

[56] References Cited

U.S. PATENT DOCUMENTS

| | | | |
|---|---|---|---|
| 2,644,307 | 7/1953 | Blair | 91/417 R X |
| 2,950,599 | 8/1960 | Burt | 60/374 |
| 3,464,317 | 9/1969 | Woodward | 92/68 |
| 3,512,072 | 5/1970 | Karazija et al. | 60/DIG. 2 |

FOREIGN PATENT DOCUMENTS

| | | | |
|---|---|---|---|
| 44-19054 | 11/1964 | Japan | 60/567 |

*Primary Examiner*—Edgar W. Geoghegan
*Attorney, Agent, or Firm*—Donald R. Cassady

[57] ABSTRACT

A high torque hydraulic power plant is operated by electrical power through the use of a hydraulic pump, opposing double-ended cylinders containing double-ended pistons and appropriate cycling valve means. Pressure is maintained in the system by a constant pneumatic force applied to the full piston side of each opposing double-ended piston.

9 Claims, 2 Drawing Figures

POWER PLANT

FIELD OF INVENTION

This invention pertains to energy conversion and transmission devices, particularly to hydraulic power plants.

More specifically, this invention relates to portable hydraulic power plants of high torque capable of being operated on self-contained electrical sources as for example, storage batteries and the like.

BACKGROUND OF THE INVENTION

Air-on-oil pistons are well known and are used as servo-motors, intensifiers, and similar devices where air pressure can be maintained at constant high pressures to do work while movement of the oil or hydraulic fluid needed to apply the pressure can be accomplished at nominal or minimal pressure and work force. Typical of such a device is that disclosed by C. H. T. Woodward in U.S. Pat. No. 3,464,317 where each cylinder of a simple double-ended cylinder piston is available to provide the push-pull action needed for reciprocating motion.

The use of double-ended cylinders with similar air-on-oil arrangements in intensifiers has been published in *Plant Engineering* for Sept. 18, 1975 at p. 149–151 by Gene Swatty entitled "Increasing Fluid Pressure with Hydraulic Intensifiers".

SUMMARY OF THE DISCLOSURE

I have intended a hydraulic motor circuit comprising two opposing double-ended cylinders containing double-ended pistons therewithin wherein the opposing full piston side in each cylinder is pressurized from a common air reservoir maintained at a sufficient air pressure to overcome the force of inertia and friction in the motor and the hydraulic circuit, and to perform work on the work piece. The other full piston side in each double-ended cylinder is oil-filled with a common oil line connected therebetween passing through a cycling valve and thereby operating a hydraulic motor connected to the work piece. The two rod-end chambers of each cylinder being alternately filled and emptied in a cyclic manner by a hydraulic pump and cycling valve, the alternate or cyclic action thereby transmitting the force of the pressurized air through the hydraulic motor and thence to the work piece.

In the preferred embodiment, a portion of the work piece comprises an alternator; a storage battery operates the hydraulic pump; and a portion of the work operates the alternator, which through appropriate circuitry, charges the storage battery during operation of the hydraulic motor.

It is obvious that the air-on-oil end of each double-ended cylinder can be enlarged in a known manner to increase the operating force of each cylinder allowing each cylinder to operate as an intensifier. This embodiment is considered to be within the scope of my invention.

The invention, the features and the advantages of the invention and the objectivity thereof will be more readily apparent and appreciated from the illustrative embodiments provided and the description following.

DETAILED DESCRIPTION OF THE DRAWINGS

Figure 1:
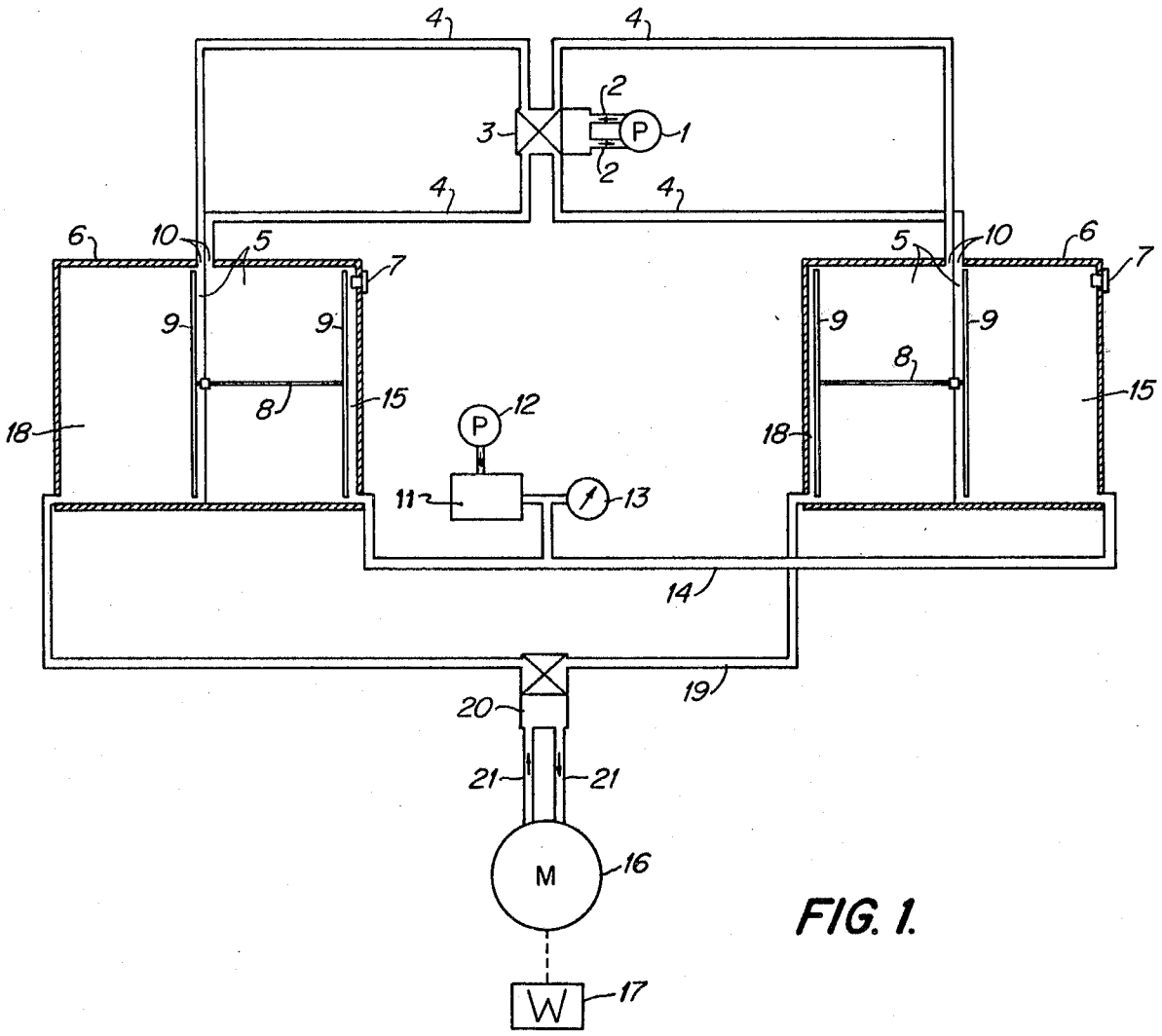
FIG. 1 is a schematic drawing of the pneumatic and hydraulic system of my invention.
Figure 2:
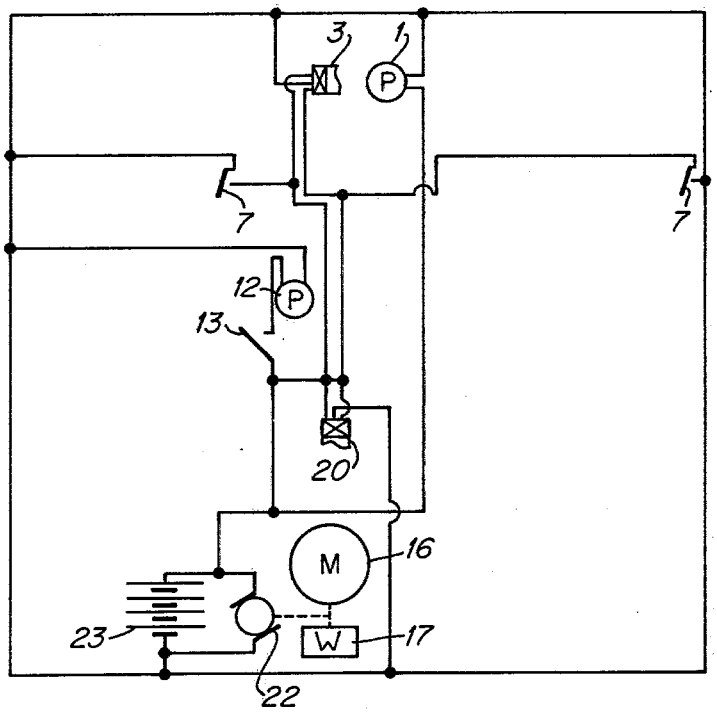
FIG. 2 is a schematic drawing of the electrical system of a preferred embodiment of my invention. This embodiment is not to be considered as limiting or illustrative of all electrical power and feedback systems which are possible, but is meant to be illustrative of one embodiment specifically intended for use as a portable power source.

The embodiment disclosed in FIGS. 1 and 2 comprises a portable hydraulic power plant.

In the embodiment, a hydraulic pump 1 feeds oil or hydraulic fluid to cycling valve 3 through appropriate circuitry 2. Fluid from the cycling valve 3 alternately fills and empties the rod-end chambers 5 of two double-ended cylinders 6 through conduit means 4 thereby providing reciprocating motion to pistons 9 and rods 8. Switching control of the cycling valve 3 is maintained by contact switches 7 or like control means in the cylinders 6. Stroke length of the rods 8 is not a controlling factor in the motor of my invention except that the pistons 9 cannot impede flow of fluid into and out of the rod-side chambers 5 through fittings 10.

A pneumatic reservoir 11 with supply pump means 12 and accompanying pressure observation and control means 13 is provided. By connecting conduit means 14, pressure within the reservoir 11 is maintained in the piston chamber 15 of each cylinder 6. A constant pressure is maintained in the pneumatic system by operation of the pressure observation and control means 13. Pressure can be varied and should be sufficient to overcome friction and inertia in the various portions of the motor and to provide power to the hydraulic motor 16 and through such motor 16 to the work piece 17.

A second hydraulic circuit is provided, comprising the remaining piston chamber 18 of each double-ended cylinder 6 and appropriate conduit means 19, connecting chambers 18 through a cycling valve 20, and through conduit means 21 to hydraulic motor 16. Control of the cycling valve 20 is provided in phase with control of cycling valve 3 by the contact switch means 7 in the cylinders 6.

In FIG. 2, appropriate circuitry is shown to provide a portable power means for the motor of my invention.

In the embodiment, the power plant of my invention is powered by a storage battery 23 and a portion of the output power of the hydraulic motor 16 is directed to an alternator or generator 22 which acts to, in part, recharge the battery 23. Appropriate circuitry is shown in the figure to connect the electrically operated components of the power plant of my invention to the battery.

During operation, electric power from the battery 23 operates pneumatic pump 12 through the observation and control means 13 to provide air pressure in reservoir 11 and thence through conduit 14 to piston chambers 15 of the two double-ended cylinders 6.

A moderate to high pressure in the system is attained and by means of the observation and control means 13 is held at any desired pressure during operation of the power plant of my invention. I have found that a pressure of about 1 atm gauge is sufficient to overcome inertial and frictional burdens and operate the motor under no load conditions. Increasing the pressure above 1 atm gauge imparts the additional available work to the work piece 17.

Electric power from the battery 23 concurrently operates hydraulic pump 1 which circulates oil or other hydraulic fluid through conduits 2, cycling valve 3, and conduits 4. Control of the cycling valve 3 by switch 7 in each cylinder 6 alternately fills and empties the rod-end chamber of each double-ended cylinder in concert. Switch 7, operated by contact with piston 9, causes a reversal of the flow in conduits 4 from cycling valve 3.

Force from the movement of the oil or hydraulic fluid in chambers 5 transmits pressure from the pneumatic chambers 15 which are allowed to equilibrate through conduit 14 to chambers 18 which are connected by conduits 19 through cycling valve 20 and conduits 21 to a hydraulic motor 16. The operation of the cycling valve 20 is controlled in the same manner and by the same means as the control of cycling valve 3, the switch means 7 on each cylinder 6.

A portion of the work out-put of hydraulic motor 16 is used to operate the generator or alternator 22 which thence feeds the battery 23.

I claim:

1. A power plant comprising two double-ended cylinders each containing double-ended pistons therewithin; a common high-pressure pneumatic force applied to one piston chamber of each cylinder; means to cyclicly reciprocate the pistons; and hydraulic means to transmit the force generated in a second piston chamber of each cylinder to a hydraulic motor.

2. The power plant of claim 1 wherein the high-pressure pneumatic force is generated by a pneumatic supply pump and pressure observation and control means.

3. The power plant of claim 2 wherein the high-pressure pneumatic force is controlled at a constant pressure throughout operation of the power plant.

4. The power plant of claim 3 wherein the constant pressure is at least one atmosphere gauge.

5. The power plant of claim 1 wherein the means to cyclicly reciprocate the pistons is provided by hydraulic fluid which cyclicly fills and empties rod-end chambers of each double-ended cylinder.

6. The power plant of claim 5 wherein the means to cyclicly fill and empty the rod-end chambers with hydraulic fluid is a hydraulic pump and cycling valve connected to the rod-end chambers by appropriate hydraulic conduits and fittings.

7. The power plant of claim 6 wherein the cycling valve is controlled by a contact switch means in the cylinder.

8. The power plant of claim 1 wherein the means to transmit the force generated in the second piston chamber of each cylinder is a cycling valve and hydraulic motor connected to the said piston chamber of the cylinder by appropriate hydraulic conduits.

9. A power plant comprising two double-ended cylinders each containing double-ended pistons therewithin; a common high pressure pneumatic force applied to one piston chamber of each cylinder; means to cyclicly reciprocate the pistons; hydraulic means to transmit the force generated in the second piston chamber of each cylinder to a hydraulic motor; a storage battery and electric circuitry to operate electrical components of the power plant; and an alternator to charge the storage battery during operation of the power plant.

* * * * *